US006647628B1

(12) United States Patent
Braaksma

(10) Patent No.: US 6,647,628 B1
(45) Date of Patent: Nov. 18, 2003

(54) TUFT-PARTING CARPET CUTTERS

(76) Inventor: Kelly E. Braaksma, 25655 Bass Point, Murrieta, CA (US) 92562

( * ) Notice: Subject to any disclaimer, the term of this patent is extended or adjusted under 35 U.S.C. 154(b) by 8 days.

(21) Appl. No.: 10/125,307

(22) Filed: Apr. 17, 2002

(51) Int. Cl.[7] ..... B26B 29/00
(52) U.S. Cl. ..... 30/294; 30/289; 30/314
(58) Field of Search ..... 30/286, 289, 294, 30/314, 315, 280; 7/103

(56) References Cited

U.S. PATENT DOCUMENTS 3,009,247 A * 11/1961 Mueller ..... 30/294
3,543,400 A 12/1970 Scott et al.
3,543,401 A 12/1970 Scott et al.
4,028,802 A * 6/1977 Houghton et al. ..... 30/294
5,044,081 A * 9/1991 Nguyen ..... 30/294
5,347,719 A * 9/1994 Scharf ..... 30/294
5,561,906 A * 10/1996 Desmarais ..... 30/339
5,881,463 A * 3/1999 Casteel et al. ..... 30/280
6,421,924 B2 * 7/2002 Anderson et al. ..... 30/294

* cited by examiner

*Primary Examiner*—Hwei-Siu Payer
(74) *Attorney, Agent, or Firm*—Loyal McKinley Hanson

(57) ABSTRACT

A carpet cutters includes a blade-supporting structure and a tuft-parting structure. The blade-supporting structure includes a longitudinally extending guide with a forward portion and a carpet-contacting edge that extends along a first axis toward the forward portion of the guide. A blade is mounted adjustably on the blade-supporting structure in a carpet-cutting position of the blade. The tuft-parting structure is on the forward portion of the guide where it functions as means for parting tufts on the carpet in order to facilitate cutting a backing portion of the carpet without cutting the tufts. The tuft-parting structure includes an elongated member with a tip. The elongated member protrudes forwardly beyond the forward end portion of the guide along a second axis that intersects the first axis, thereby to facilitate positioning of the tip of the elongated structure in between adjacent tufts of the carpet.

19 Claims, 3 Drawing Sheets

Fig. 2
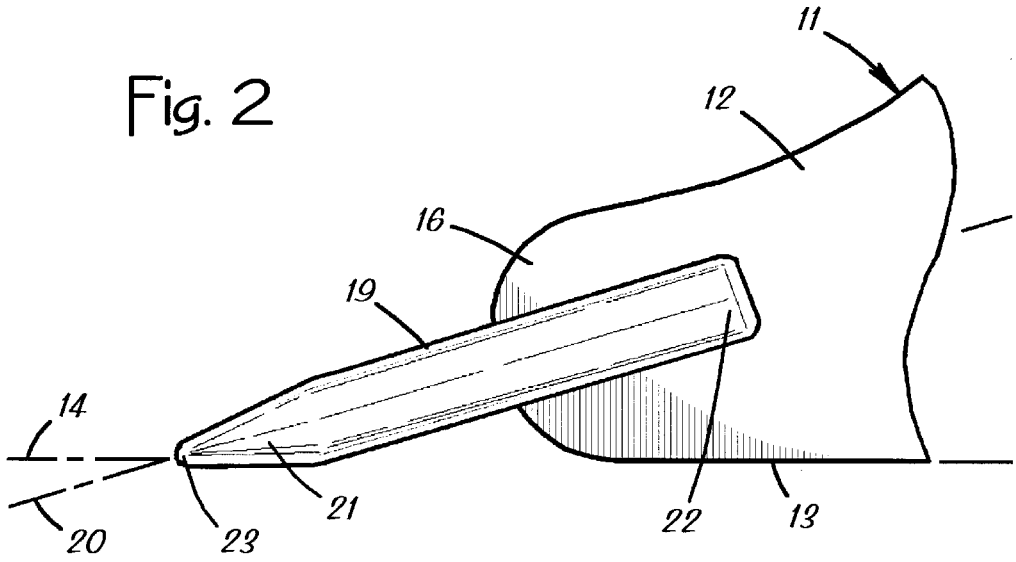
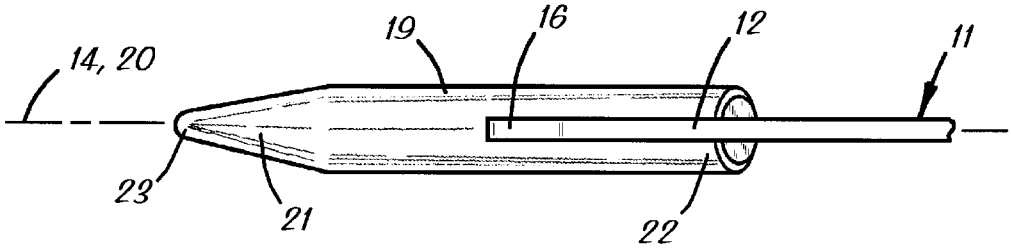
Fig. 3

TUFT-PARTING CARPET CUTTERS

BACKGROUND OF THE INVENTION

1. Technical Field

This invention relates generally to hand tools for carpet installation, and more particularly to a carpet-cutting tool having a tuft-parting component that facilitates cutting along a desired row or wire.

2. Description of Related Art

The term "carpet cutter" refers to a carpet-cutting tool. It includes a blade-holding structure that the carpet installer grasps with one hand and slides along a piece of carpet in order to cause a downwardly protruding blade to cut the carpet along a desired row or wire. Carpet cutters are well known and commonly used tools. Examples of a cushion-back carpet cutter and a loop-pile carpet cutter appear in U.S. Pat. Nos. 3,543,400 and 3,543,401.

In using the carpet cutters, the carpet installer cuts between adjacent pile tufts so that the carpet pile tufts are less prone to be cut off by the blade of the cutters. A longitudinally extending guide is provided on the blade-holding structure to facilitate the process. The guide includes a downwardly facing, carpet-contacting edge that extends to a forward portion or "nose" of the guide. The carpet installer slides the carpet-contacting edge along the carpet while burrowing the nose through adjacent tufts, and this helps separate the tufts to in order to help the carpet cutter avoid cutting the tufts.

The problem is that the nose of the guide is not entirely successful in parting the tufts, especially during the initial stage of making a cut. Initially, the carpet installer forces the nose downwardly between the tufts in order to position the carpet-contacting edge against the carpet. But the nose of the guide simply does not burrow in between adjacent tufts as desired. Often the nose simply flattens the tufts instead of parting them. The blade will then cut or sheer off the tufts.

Confronted with this problem, carpet installers often use a ball point pen or awl to part the tufts. But that technique involves the time and inconvenience associated with using another tool. Moreover, the carpet installer must develop the skill to hold and operate both tools simultaneously in order to part the tufts with one tool while making the cut with the other, or undertake a two-step process with first the separator tool and then the cutting tool. Thus, carpet installers need a carpet cutter with a better tuft-parting arrangement.

SUMMARY OF THE INVENTION

It is an object of this invention to overcome the forgoing and other disadvantages of prior art carpet cutters. This object is achieved by providing an effective tuft-parting structure on the nose of a carpet cutter. The tuft-parting structure is part of the carpet cutter. It takes the form of an elongated member on the nose of the guide that extends forwardly beyond the nose to a tip of the elongated member (preferably conically shaped). The tip sticks out beyond the nose in position to effectively burrow between and part adjacent tufts without the need for a second tool.

To paraphrase some of the more precise language appearing in the claims, a carpet cutter constructed according to the invention includes a blade-supporting structure with a guide and a tuft-parting structure. The guide has a forward portion (i.e., a nose) and a carpet-contacting edge that a carpet installer slides along a carpet when using the carpet cutters to cut the carpet. The carpet-contacting edge extends along a first axis toward the forward portion of the guide, while the tuft-parting structure is on the forward portion of the guide where it functions as means for parting tufts on the carpet in order to facilitate carpet cutting.

According to a major aspect of the invention, the tuft-parting structure includes an elongated member with a tip. The elongated member protrudes forwardly beyond the forward end portion of the guide along a second axis that intersects the first axis. Arranged in that way, the elongated member facilitates the carpet installer's task of positioning the tip of the elongated structure in between adjacent tufts of the carpet as an initial step in parting the tufts and as the carpet installer positions the carpet-contacting edge of the guide against the carpet.

Preferably, the tip of the elongated member is conically shaped and the rest of the elongated member is cylindrically shaped. The illustrated embodiment is composed of metal and it is attached to the forward portion of the guide. The first and second axes form an angle in the range of about five degrees to about sixty degrees. Preferably, that angle is about fifteen degrees. The tuft-parting cutters can take any of various known forms of carpet cutter, including that of a cushion-back cutter or a loop-pile cutter.

Thus, the tip of the elongated member sticks out beyond the nose for use in burrowing between and parting adjacent tufts. It does this effectively and it eliminates the need for a second tool. The following illustrative drawings and detailed description make the foregoing and other objects, features, and advantages of the invention more apparent.

BRIEF DESCRIPTION OF THE DRAWINGS

FIG. 2 is an enlarged side elevation view of the tuft-parting be portion of the carpet cutter;

FIG. 3 is a top plan view of the tip portion of the carpet cutter; and;

DESCRIPTION OF THE PREFERRED EMBODIMENTS

Figure 1:
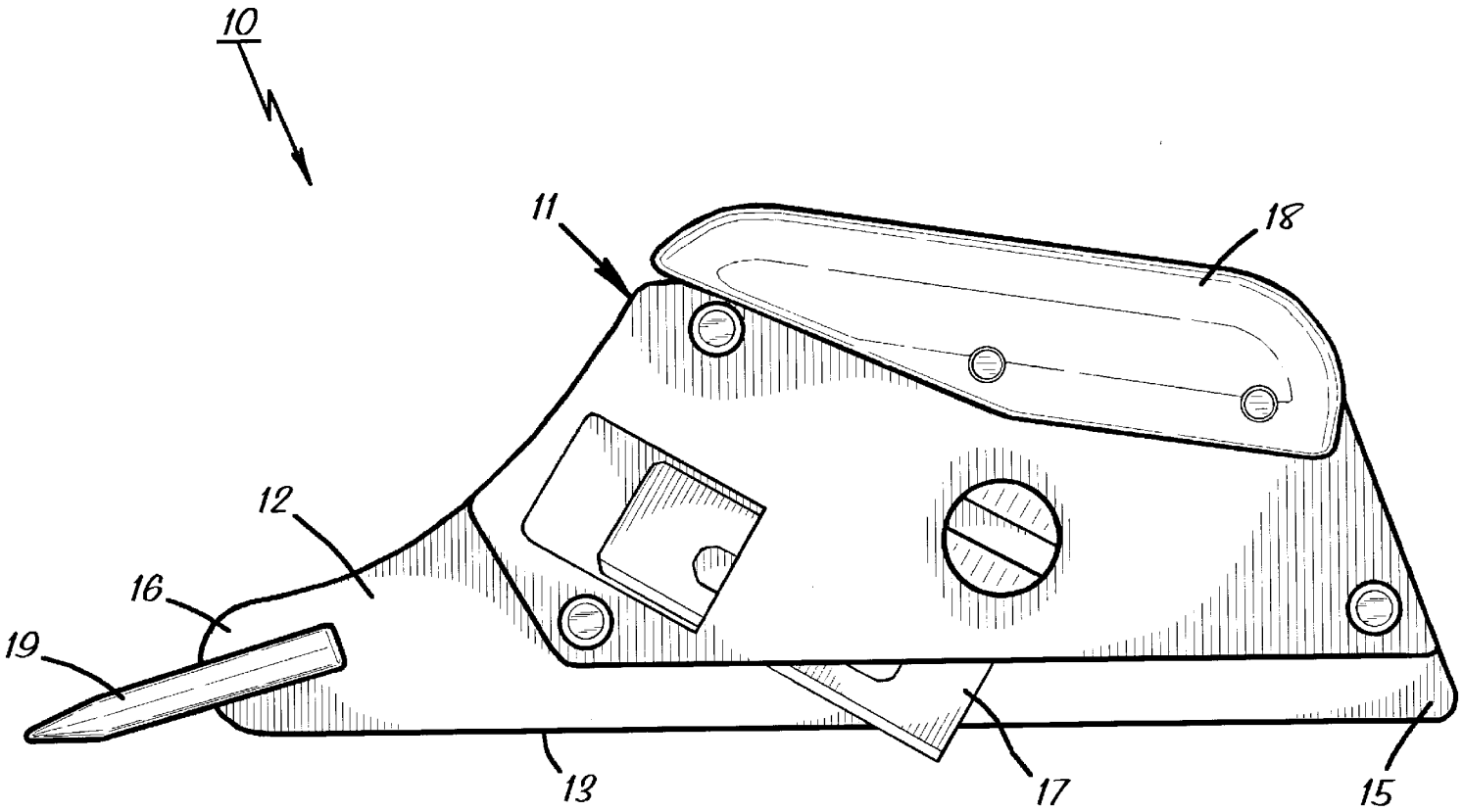
FIG. 1 of the drawings is a side elevation view of a carpet cutter constructed according to the invention.

FIGS. 1–3 of the drawings show various aspects of a carpet cutter 10 constructed according to the invention. Generally, the carpet cutter 10 includes a blade-holding structure 11 having a guide 12 (a guide member visible in FIG. 1) for guiding the carpet cutters 10 across a carpet (not shown) when making a cut in the carpet. The guide 12 includes a carpet-contacting edge 13 that extends along a longitudinally extending first axis 14 (FIGS. 2 and 3) from a rearward portion 15 of the guide 12 to a forward portion or nose 16 of the guide 12 that is identified in FIGS. 1, 2, and 3. Those aspects may be similar in some respects to existing carpet cutter. As an idea of size, the guide 12 of the carpet cutter 10 is about seven to eight inches in overall length measured parallel to the first axis 14, and the other parts are sized accordingly. Reference may be made to U.S. Pat. Nos. 3,543,400 and 3,543,401 for some additional nomenclature and construction details of prior art carpet cutters and the carpets they are used to cut.

A user of the carpet cutter 10 adjusts a blade 17 on the blade-holding structure 11 in a known way so that the blade 17 extends downwardly beyond the edge 13 to a deployed or carpet-cutting position of the blade 17 illustrated in FIG. 1. Grasping a handle 18 on the blade-holding structure 11 in one hand, the user then positions the carpet-contacting edge 13 toward a carpet to be cut (not shown) in preparation for moving the carpet cutter 10 along the carpet with the blade 17 making a desired cut in the carpet. As an initial step in positioning the edge 13 against the carpet, the user first parts adjacent carpet tufts to clear a path of travel for the carpet-contacting edge 13. To part the tufts more efficiently than forcing the nose of the guide 12 between the tufts, some users use a ball point pen, awl, or other tool, but the carpet cutters 10 eliminates the need for doing so.

Unlike prior art carpet cutters, the carpet cutter 10 includes a tuft-parting structure 19 on the nose 16 of the guide 12. The tuft-parting hi structure 19 extends forwardly beyond the nose 16 along a second axis 20 that is identified in FIGS. 2 and 3. It functions as a slender, pointed, tubular poker for parting carpet pile tufts, both initially as the user positions the carpet-contacting edge 13 on the carpet to be cut and subsequently as the user moves the carpet cutters 10 across the carpet to make the desired cut.

The tuft-parting structure 19 of the carpet cutter 10 takes the form of a quarter-inch diameter, two-inch long, cylindrically shaped, metal rod having a forward end portion referred to herein as a tip 21 and a rearward end portion 22 (FIGS. 2 and 3). The rearward end portion 22 is slotted to accept the guide 12 which is made from a metal plate measuring about 0.1-inch or so thick. The rearward end portion 22 is welded or otherwise suitably affixed to the nose 16 of the guide 12 to hold it in place. Of course, the above dimensions, the cylindrical shape, and the composition of the tuft-parting structure 19 may vary from that described within the broader inventive concepts disclosed.

Additionally, the tip 21 of the tuft-parting structure 19 is conically shaped as illustrated, extending to a rounded end 23 that burrows effectively between adjacent tufts in place of the ball point pen, awl, or other tool used by some carpet installers for tuft-parting purposes. The illustrated conically shaped tip 21 is about one-half inch long.

As for the inclination of the tuft-parting structure 19, it is set so that the second axis 20 forms an acute angle with the first axis 14 lying in the range of about five to about sixty degrees. Preferably the acute angle lies in the range of about five degrees to about twenty-five degrees, with an acute angle of about fifteen degrees being illustrated. The illustrated fifteen-degree angle has been found to provide an effective balance between the initial downward burrowing between adjacent tufts undertaken in preparation for placing the carpet-contacting edge 13 against the carpet, and the subsequent forward burrowing occurring as the user moves the carpet-contacting edge 13 across the carpet to make a desired cut.

Notice that the overhang introduced by having the tuft-parting structure 19 inclined and protruding beyond the nose 16 results in a space between the conically shaped tip 21 and the nose 16 along the first axis 14 (e.g., a space about one-half of an inch to three-quarters of an inch or so long). That space helps avoid packing the tufts downwardly during the initial parting of adjacent tufts and positioning of the carpet-contacting edge 13 against the carpet.

Figure 4:
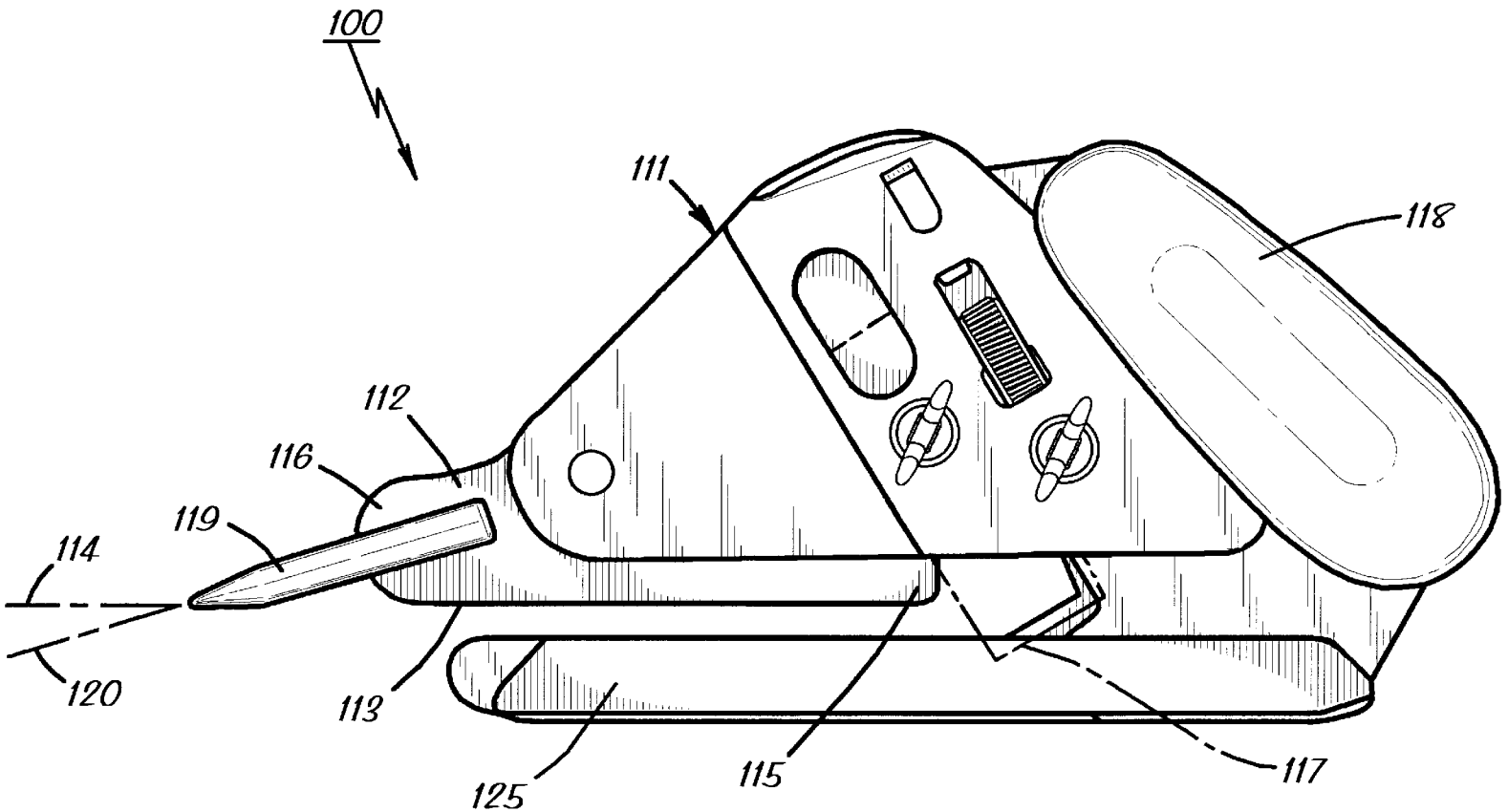
FIG. 4 is a side elevation view of a second embodiment of the invention in the form of a loop-pile cutter having a base member that the carpet installer positions between the carpet and the floor.

Turning now to FIG. 4, it shows a second embodiment of the invention in the form of a loop-pile carpet cutters 100. The carpet cutters 100 is similar in some respects to the carpet cutters 10 and so only differences are described in further detail. For convenience, reference numerals designating parts of the carpet cutters 100 are increased by one hundred over those designating similar or related parts of the carpet cutters 10.

The major difference in the carpet cutters 100 is that it includes a known type of lower member 125 that slides beneath the carpet in a known manner as the carpet-contacting edge 113 of a guide 112 slides across the carpet. In other words, a tuft-parting structure configured according to the invention can be included on any of various known types of carpet cutters. Other than that difference, the carpet cutters 100 is generally similar to the carpet cutter 10. It includes a blade-holding structure 111 for holding a blade 117 (illustrated in phantom lines), a handle 118, and a nose 116 of the guide 112 to which a tuft-parting structure 119 is attached. The tuft-parting structure 119 extends beyond the nose 116 of the guide 112 on an incline along a second axis 120 that intersects a first axis 114 (of the carpet-contacting edge 113) as described for the carpet cutters 10.

Thus, the invention provides a carpet cutters having a tuft-parting structure in the form of an elongated member with a tip that sticks out beyond the nose for use in burrowing between and parting adjacent tufts. It functions as a slender, pointed, tubular poker for parting carpet pile tufts, both initially as the user positions the carpet-contacting edge of the carpet cutters on the carpet to be cut and subsequently as the user moves the carpet cutters across the carpet to make the desired cut. It does this effectively and it eliminates the need for a second tool. Although an exemplary embodiment has been shown and described, one of ordinary skill in the art may make many changes, modifications, and substitutions without necessarily departing from the spirit and scope of the invention.

What is claimed is:

1. A carpet cutters comprising:

a blade-supporting structure, the blade-supporting structure including a guide with a forward portion and a carpet-contacting edge that a carpet installer slides along a carpet when using the carpet cutter to cut a backing portion of the carpet, which carpet-contacting edge extends along a first axis toward the forward portion of the guide;

a blade mounted adjustably on the blade-supporting structure to enable adjustment of the blade to a carpet-cutting position of the blade in which the blade extends downwardly from the blade-supporting structure beyond the carpet-contacting edge of the guide; and a tuft-parting structure on the forward portion of the guide that functions as means for parting tufts on the carpet in order to facilitate carpet cutting;

wherein the tuft-parting structure includes an elongated member with a tip; and wherein the elongated member protrudes forwardly beyond the forward portion of the guide along a second axis that intersects the first axis, thereby to facilitate positioning of the tip in between adjacent tufts of the carpet as an initial step in parting the tufts and positioning the carpet-contacting edge of the guide against the backing portion of the carpet.

2. A carpet cutter as recited in claim 1, wherein the tip of the elongated member is conically shaped.

3. A carpet cutter as recited in claim 1, wherein the elongated member is cylindrically shaped.

4. A carpet cutter as recited in claim 1, wherein the elongated member includes a rearward end portion that is connected to the forward portion of the guide.

5. A carpet cutter as recited in claim 1, wherein the elongated member is composed of metal.

6. A carpet cutter as recited in claim 1, wherein the first and second axes form an angle in the range of about five degrees to about sixty degrees.

7. A carpet cutter as recited in claim 1, wherein the first and second axes form an angle of about fifteen degrees.

8. A carpet cutter as recited in claim 1, wherein the blade-supporting structure is a blade-holding structure of a cushion-back cutter.

9. A carpet cutter as recited in claim 1, wherein the blade-supporting structure is a blade-holding structure of a loop-pile cutter.

10. A carpet cutter, comprising:

a blade-supporting structure, the blade-supporting structure including a guide with a forward portion and a carpet-contacting edge that a carpet installer slides along a carpet when using the carpet cutter to cut the carpet, which carpet-contacting edge extends along a first axis toward the forward portion of the guide; and a tuft-parting structure on the forward portion of the guide that functions as means for parting tufts on the carpet in order to facilitate cutting a backing portion of the carpet without cutting the tufts;

wherein the tuft-parting structure includes an elongated member with a tip; and wherein the elongated member protrudes forwardly beyond the forward portion of the guide along a second axis that intersects the first axis, thereby to facilitate positioning of the tip in between adjacent tufts of the carpet as an initial step in parting the tufts and positioning the carpet-contacting edge of the guide against the backing of the carpet.

11. A carpet cutter as recited in claim 10, wherein the tip of the elongated member is conically shaped.

12. A carpet cutter as recited in claim 10, wherein the elongated member is cylindrically shaped.

13. A carpet cutter as recited in claim 10, wherein the elongated member includes a rearward end portion that is connected to the forward portion of the guide.

14. A carpet cutter as recited in claim 10, wherein the elongated member is composed of metal.

15. A carpet cutter as recited in claim 10, wherein the first and second axes form an angle in the range of about five degrees to about sixty degrees.

16. A carpet cutter as recited in claim 10, wherein the first and second axes form an angle of about fifteen degrees.

17. A carpet cutter as recited in claim 10, wherein the blade-supporting structure is a blade-supporting structure of a cushion-back cutter.

18. A carpet cutter as recited in claim 10, wherein the blade-supporting structure is a blade-supporting structure of a loop-pile cutter.

19. A carpet cutter, comprising:

a blade-supporting structure, the blade-supporting structure including a guide with a forward portion and a carpet-contacting edge that a carpet installer slides along a carpet when using the carpet cutter to cut the carpet, which carpet-contacting edge extends along a first axis toward the forward portion of the guide; and a tuft-parting structure on the forward portion of the guide that functions as means for parting tufts on the carpet in order to facilitate carpet cutting;

wherein the tuft-parting structure includes an elongated member with a tip; and wherein the elongated member protrudes forwardly beyond the forward portion of the guide along a second axis that intersects the first axis, thereby to facilitate positioning of the tip in between adjacent tufts of the carpet as an initial step in parting the tufts and positioning the carpet-contacting edge of the guide against the carpet;

wherein the tip of the elongated member is conically shaped; and wherein the first and second axes form an angle of about five to about twenty-five degrees.

* * * * *